US010987268B2

(12) United States Patent
Souke et al.

(10) Patent No.: US 10,987,268 B2
(45) Date of Patent: Apr. 27, 2021

(54) EMERGENCY COT WITH A LITTER HEIGHT ADJUSTMENT MECHANISM

(71) Applicant: Stryker Corporation, Kalamazoo, MI (US)

(72) Inventors: Chad Conway Souke, Portage, MI (US); Christopher Gentile, Sturgis, MI (US); Ross Timothy Lucas, Paw Paw, MI (US); Michael T. Brubaker, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 214 days.

(21) Appl. No.: 15/949,624

(22) Filed: Apr. 10, 2018

(65) Prior Publication Data

US 2018/0303689 A1 Oct. 25, 2018

Related U.S. Application Data

(60) Provisional application No. 62/488,441, filed on Apr. 21, 2017.

(51) Int. Cl.
*A61G 7/10* (2006.01)
*A61G 1/052* (2006.01)
(Continued)

(52) U.S. Cl.
CPC ..... *A61G 7/1036* (2013.01); *A61G 1/052* (2013.01); *A61G 1/0567* (2013.01);
(Continued)

(58) Field of Classification Search
CPC ..... A61G 1/025; A61G 1/0262; A61G 1/013; A61G 1/052; A61G 1/0567; A61G 1/1034;
(Continued)

(56) References Cited

U.S. PATENT DOCUMENTS 3,530,514 A 9/1970 McCalley
3,627,377 A 12/1971 Pickles
(Continued)

FOREIGN PATENT DOCUMENTS

DE 3313843 A1 10/1984
EP 0364394 A2 4/1990
(Continued)

OTHER PUBLICATIONS

Stryker Bertec Medical Inc., "The Go Bed Electric Acute Care Bed Maintenance Manual", Dec. 2000, pp. 1-64.
(Continued)

*Primary Examiner* — David R Hare
*Assistant Examiner* — Adam C Ortiz
(74) *Attorney, Agent, or Firm* — Warner Norcross + Judd LLP

(57) ABSTRACT

An emergency cot includes a litter frame, a base, and a lift assembly supporting the litter frame relative to the base. The lift assembly includes load bearing members pivotally coupled to the litter frame by head-end upper pivot connections and foot-end upper pivot connections and to the base by head-end lower pivot connections and foot-end lower pivot connections for raising or lowering the base or the litter frame with respect to the other. The foot-end upper pivot connections or head-end upper pivot connections are movable toward or away from the longitudinal axis of the litter frame to allow one end of the litter frame to be tilted upwardly.

16 Claims, 11 Drawing Sheets

(51) Int. Cl.

| | |
|---|---|
| ***A61G 1/056*** | (2006.01) |
| ***A61G 7/005*** | (2006.01) |
| ***A61G 1/02*** | (2006.01) |
| ***A61G 1/013*** | (2006.01) |
| ***A61G 7/012*** | (2006.01) |

(52) U.S. Cl.
CPC ..... *A61G 7/1034* (2013.01); *A61G 1/013* (2013.01); *A61G 1/02* (2013.01); *A61G 7/005* (2013.01); *A61G 7/012* (2013.01)

(58) Field of Classification Search
CPC ..... A61G 1/02; A61G 7/1036; A61G 7/1034; A61G 7/005; A61G 7/0212
See application file for complete search history.

(56) References Cited

U.S. PATENT DOCUMENTS

| | | | | |
|---|---|---|---|---|
| 4,747,212 | A | 5/1988 | Cavdek | |
| 5,102,377 | A | 4/1992 | Spanski | |
| 5,161,274 | A | 11/1992 | Hayes et al. | |
| 5,355,743 | A | 10/1994 | Tesar | |
| 5,613,255 | A | 3/1997 | Bish et al. | |
| 6,071,228 | A | 6/2000 | Speraw et al. | |
| 6,289,534 | B1 | 9/2001 | Hakamiun et al. | |
| 6,421,854 | B1 | 7/2002 | Heimbrock | |
| 6,611,979 | B2 | 9/2003 | Welling et al. | |
| 6,659,935 | B2 | 12/2003 | Costanzo | |
| 6,886,200 | B2 | 5/2005 | Blyshak et al. | |
| 7,140,055 | B2 | 11/2006 | Bishop et al. | |
| 7,150,056 | B2 | 12/2006 | Lemire | |
| 7,171,708 | B2 | 2/2007 | Osborne et al. | |
| 7,296,312 | B2 | 11/2007 | Menkedick et al. | |
| 7,441,291 | B2 | 10/2008 | Hayes et al. | |
| 7,454,805 | B2 | 11/2008 | Osborne et al. | |
| 7,533,429 | B2 | 5/2009 | Menkedick et al. | |
| 7,610,637 | B2 | 11/2009 | Menkedick et al. | |
| 7,653,954 | B2 | 2/2010 | Hornbach et al. | |
| 7,703,158 | B2 | 4/2010 | Wilker, Jr. et al. | |
| 7,886,380 | B2 | 2/2011 | Hornbach et al. | |
| 7,913,335 | B2 | 3/2011 | Carr | |
| 7,926,131 | B2 | 4/2011 | Menkedick et al. | |
| 8,074,309 | B2 | 12/2011 | Hutchison et al. | |
| 8,104,120 | B2 | 1/2012 | Hornbach et al. | |
| RE43,193 | E | 2/2012 | Osborne et al. | |
| 8,151,387 | B2 | 4/2012 | Osborne et al. | |
| 8,176,584 | B2 * | 5/2012 | Hornbach | A61G 7/012 378/209 |
| 8,256,048 | B2 | 9/2012 | Bly et al. | |
| 8,291,532 | B2 | 10/2012 | Hornbach et al. | |
| 8,321,976 | B1 | 12/2012 | Edgerton | |
| 8,458,833 | B2 | 6/2013 | Hornbach et al. | |
| 8,502,663 | B2 | 8/2013 | Riley et al. | |
| 8,607,384 | B2 | 12/2013 | Hornbach | |
| 8,621,690 | B2 | 1/2014 | Hornbach et al. | |
| 8,844,078 | B2 | 9/2014 | Hornbach et al. | |
| 9,227,822 | B2 | 1/2016 | Horne | |
| 2002/0178502 | A1 | 12/2002 | Beasley et al. | |
| 2004/0055087 | A1 | 3/2004 | Edgerton | |
| 2009/0222988 | A1 * | 9/2009 | Reed | A61G 1/0287 5/627 |
| 2010/0000017 | A1 | 1/2010 | Laloge et al. | |
| 2010/0199433 | A1 | 8/2010 | Clenet | |
| 2012/0124746 | A1 | 5/2012 | Andrienko et al. | |
| 2014/0033435 | A1 | 2/2014 | Jutras | |
| 2014/0041120 | A1 | 2/2014 | Li | |
| 2014/0189954 | A1 | 7/2014 | Lee | |
| 2014/0325759 | A1 | 11/2014 | Bly et al. | |
| 2016/0136021 | A1 | 5/2016 | Roussy et al. | |
| 2016/0302985 | A1 | 10/2016 | Tessmer et al. | |
| 2018/0214326 | A1 | 8/2018 | Lacasse et al. | |

FOREIGN PATENT DOCUMENTS

| | | | |
|---|---|---|---|
| EP | 0736275 | B1 | 1/2000 |
| JP | H02156950 | A | 6/1990 |
| KR | 20140003301 | A | 1/2014 |
| WO | 9629970 | | 10/1996 |
| WO | 0117399 | A1 | 3/2001 |
| WO | 0117400 | A1 | 3/2001 |
| WO | 0123847 | A1 | 4/2001 |
| WO | 2007069912 | A1 | 6/2007 |
| WO | 2013066198 | A1 | 5/2013 |
| WO | 2014150652 | A1 | 9/2014 |
| WO | 2014191684 | A1 | 12/2014 |
| WO | 2015032003 | A1 | 3/2015 |

OTHER PUBLICATIONS

Stryker Bertec Medical Inc., "The Go Bed Electric Acute Care Bed Operations Manual", Dec. 2000, pp. 1-26.

* cited by examiner

EMERGENCY COT WITH A LITTER HEIGHT ADJUSTMENT MECHANISM

This application claims the benefit of U.S. Prov. Appl. Ser. No. 62/488,441, filed on Apr. 21, 2017, entitled EMERGENCY COT WITH A LITTER HEIGHT ADJUSTMENT MECHANISM, by Applicant Stryker Corporation, which is hereby incorporated by reference in its entirety.

TECHNICAL FIELD AND BACKGROUND OF THE INVENTION

The present invention relates to a patient support apparatus, such as an emergency cot or stretcher or the like, and, more particularly, to an emergency cot that provides an adjustable litter that eases loading of the cot into an emergency vehicle, such as an ambulance.

When a cot is loaded, for example into an ambulance, the litter frame must be raised to a height that is sufficient so that the head-end of the cot can be moved into the compartment of the ambulance, and thereafter the base can be raised so that the whole cot can be pushed into the ambulance. Often this height is above the fully raised height of a cot. To address this, some ambulances are equipped with tilt trays or loading arms that are extended from the rear opening of the compartment and extended under or into the cot to guide or lift the cot to the proper loading height. Ambulances, not so equipped, require the emergency medical technicians to raise the litter relative to the base where it is near the compartment deck height and, thereafter, in some cases, lift the cot so that the head-end wheel on the litter frame can be supported on the compartment deck after which the base can be raised and the cot rolled on the deck into the compartment.

Accordingly, there is a need to provide a cot with a litter frame that can be adjusted to facilitate loading of the cot into an emergency vehicle.

SUMMARY OF THE INVENTION

Accordingly, the emergency cot of the present invention provides a lift assembly with a compliant mechanism to increase the range of motion of the litter frame and thereby allow loading into a wide range of ambulance compartment heights.

In one form of the invention, a cot includes a litter frame with a head-end and a foot-end, a base, and a lift assembly supporting the litter frame relative to the base. The lift assembly includes load bearing members, such as compression/tension members, that are pivotally mounted to the litter frame and the base by head-end and foot-end upper pivot connections and head-end and foot-end lower pivot connections, respectively, for raising or lowering the base or the litter with respect to the other. The foot-end or head-end upper pivot connections are configured to move toward or away from the longitudinal axis of the litter frame to allow the head-end or the foot-end of the litter frame to tilt upwardly.

In one aspect, the foot-end upper pivot connections are movable. For example, the foot-end upper pivot connections are movable in a direction oblique to the longitudinal axis of the litter frame.

In another aspect, the foot-end upper pivot connections are movable along a non-linear path in a direction oblique to said longitudinal axis of the litter frame over a portion of the range of motion of the foot-end upper pivot connections.

In further aspects, the foot-end upper pivot connections are mounted relative to the litter frame by guides. For example, each of the guides may have an elongate guide surface, with each of the elongate guide surfaces having one or more non-linear sections.

In other aspects, the foot-end upper pivot connections comprise rolling foot-end upper pivot connections. In a further aspect, each of the rolling foot-end upper pivot connections includes a roller to roll along a respective elongate guide surface.

According to other aspects, each of the guides has an elongate recess or opening formed therein, with the elongate recesses or openings defining the elongate guide surfaces. For example, each of the guides may be formed from a low friction material, such as a high density polyethylene material.

In yet other aspects, each of the elongate guide surfaces has a first section corresponding to a lowered and substantially un-tilted position of the litter frame and a second section corresponding to a raised and tilted position of the litter frame. The second sections are tilted relative to the first sections to allow the foot-end upper pivot connections to move along the longitudinal axis of the litter frame and to move toward or away from the longitudinal axis of the litter frame to thereby allow the litter frame to be tilted without decoupling the litter frame from the load bearing members.

In one embodiment, the loading bearing members comprise telescoping compression/tension members.

Further, the telescoping compression/tension members may comprise a first pair of telescoping compression/tension members forming a first X-frame and a second pair of telescoping compression/tension members forming a second X-frame.

In one aspect, the telescoping compression/tension members of the first pair of telescoping compression/tension members are connected together at a generally medial portion thereof by a pivot. The telescoping compression/tension members of the second pair of telescoping compression/tension members are connected together at a generally medial portion thereof by another pivot, with the head-end upper pivot connections forming stationary pivot connections at the litter frame, and the foot-end upper pivot connections forming movable connections at the litter frame and being joined by a transverse member.

In yet a further aspect, the foot-end upper pivot connections are configured to allow the head-end of the litter frame to be tilted upwardly without decoupling the litter frame from the load bearing members.

According to another embodiment, an emergency cot includes a litter frame, a base, and a lift assembly supporting the litter frame relative to the base. The lift assembly includes load bearing members, such as compression/tension members, that are pivotally mounted to the litter frame and the base by head-end and foot-end upper pivot connections and head-end and foot-end lower pivot connections, respectively, for raising or lowering the base or the litter with respect to the other. The foot-end or head-end upper pivot connections are configured to move along a non-linear path to allow the head-end or the foot-end of the litter frame to tilt upwardly.

In one aspect, the non-linear path includes one or more linear portions.

In a further aspect, the non-linear path includes one or more arcuate portions.

In yet other aspects, the foot-end upper pivot connections comprise movable foot-end upper pivot connections movable along said non-linear path and are mounted relative to said litter frame by guides.

Further, the upper pivot connections are configured to allow the head-end of the litter frame to be tilted upwardly without decoupling the litter frame from the load bearing members.

According to yet another aspect, the loading bearing members form a pair of X-frames. Each of the X-frames comprises a pair of telescoping members adapted and arranged to raise or lower the base or the litter frame relative to the other of the base and the litter frame. Each of the X-frames is pivotally mounted relative to the litter frame by a respective head-end upper pivot connection and a respective movable foot-end upper pivot connection and pivotally mounted relative to the base by a respective head-end lower pivot connection and a respective foot-end lower pivot connection. Each of the foot-end upper pivot connections is configured to move along the non-linear path to allow the head-end of the litter frame to be tilted upwardly.

In one aspect, the foot-end upper pivot connections are mounted relative to the litter frame by guides, with each of the guides forming a non-linear guide path for a respective foot-end upper pivot connection. For example, the foot-end upper pivot connections may comprise rolling foot-end upper pivot connections.

In yet another aspect, each of the non-linear guide paths has a first section corresponding to a lowered and substantially un-tilted position of the litter frame and a second section corresponding to a raised and tilted position of the litter frame. The second sections are adjacent the first sections and are tilted upwardly relative to the first sections to allow the foot-end upper pivot connections to move along the non-linear path to allow the head-end of the litter frame to be tilted upwardly without decoupling the litter frame from the X-frames.

According to yet another form of the invention, a method for adjusting the height of a litter deck of an emergency cot, where the emergency cot has a litter frame supporting the litter deck, a base, and a lift assembly coupled to the litter frame and to the base to raise or lower the base or the litter frame relative to the other, includes extending the lift assembly to raise the litter frame, and tilting the litter frame relative to the lift assembly while still remaining coupled to the lift assembly.

In one aspect, the tilting includes applying a downward force at or near one end, such as a foot-end, of the litter frame.

In a further aspect, the lift assembly is coupled to the litter frame by head-end and foot-end upper pivot connections, and the tilting further including guiding the foot-end upper pivot connections along the non-linear path when the downward force is applied to the foot-end of the litter frame.

In yet another embodiment, a patient support apparatus includes a deck for supporting a patient and a lift assembly. The lift assembly is coupled to the deck by a first pivot and a second pivot. The first pivot has a first pivot axis fixed in position along the longitudinal axis of the deck. The second pivot has a second pivot axis that is guided along a guide path of a guide with respect to the longitudinal axis of the deck. The guide path forms an oblique angle relative to the longitudinal axis of the deck over at least a portion of the guide path. The first end of the deck extends in a cantilevered arrangement beyond the first pivot, and the second end of the deck extends in a cantilevered arrangement beyond the second pivot wherein a force applied adjacent to or at the second end raises the first end of the deck beyond the first pivot.

In one aspect, the guide path includes at least one curved portion.

In another aspect, the first end of the deck extends in a cantilevered arrangement beyond the first pivot, and the second end of the deck extends in a cantilevered arrangement beyond the second pivot wherein a force applied adjacent to or at the second end of the deck shifts the relative distribution of the weight between the first pivot and the second pivot in such a way as to cause a reduction in force on the first pivot and an increase in the relative force on the second pivot.

In yet another aspect, the first end extends in a cantilevered arrangement beyond the first pivot, and the second end of the deck extending in a cantilevered arrangement beyond the second pivot wherein when a force is applied adjacent to or at the second end the guide forms a cam operable to urge the second pivot closer to the first pivot.

For example, the guide path may include at least one curved portion, with the curved portion forming the cam.

In yet other aspects, the first end of the deck comprises a head-end of the deck, and the second end comprises a foot-end of the deck.

Accordingly, the present invention provides a cot with an improved litter adjustment mechanism.

These and other objects, advantages, purposes and features of the invention will become more apparent from the study of the following description taken in conjunction with the drawings.

DETAILED DESCRIPTION OF THE INVENTION

Figure 1:
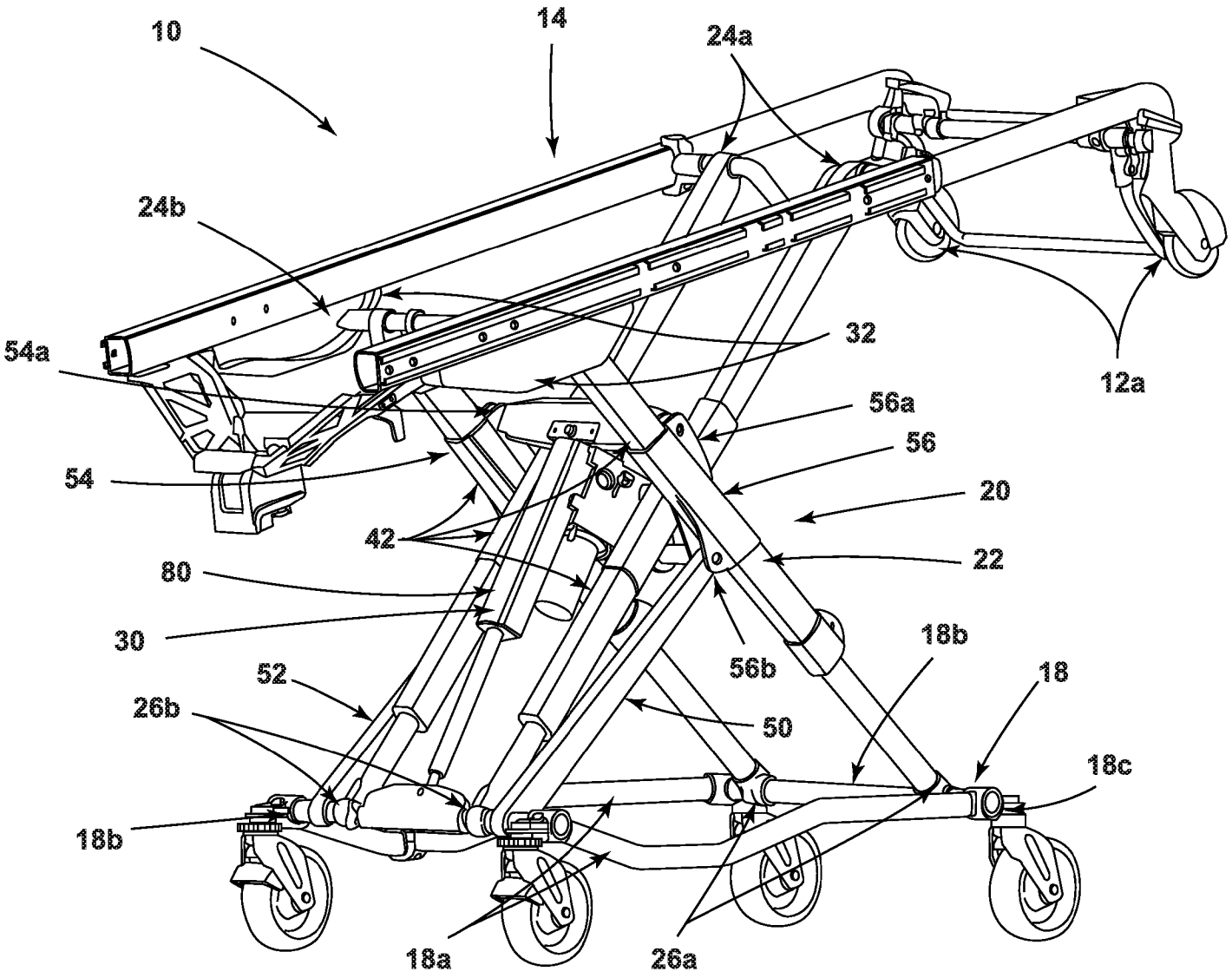
FIG. 1 is a perspective view of an emergency cot (with the litter deck removed) with the lift assembly in its fully raised configuration.

Referring to FIGS. 1-5, the numeral 10 generally designates an emergency cot or stretcher. As best seen in FIG. 1B, emergency cot 10 includes a deck, such as a litter 12, which includes a litter frame 14 and litter deck 16 (see also FIG. 1C) that supports a patient, and a base 18. As will be more fully described below, cot 10 includes a lift assembly 20 that raises or lowers the base 18 or the litter 12 with respect to the other so that the cot can be rearranged between a more compact configuration for loading into an emergency vehicle, such as an ambulance, and a configuration for use in transporting a patient across a ground surface, as well as for loading the cot 10 into an emergency vehicle. Further, as will be more fully described below, the mounting of lift assembly 20 to the litter frame 14 is configured to allow the litter 12 to be tilted relative to the lift assembly 20 so that one end (e.g. head-end or foot-end) of the litter 12 can be raised beyond the fully raised height of the lift assembly to allow the cot 10 to be inserted more easily into the compartment of an emergency vehicle.

Figure 1A:
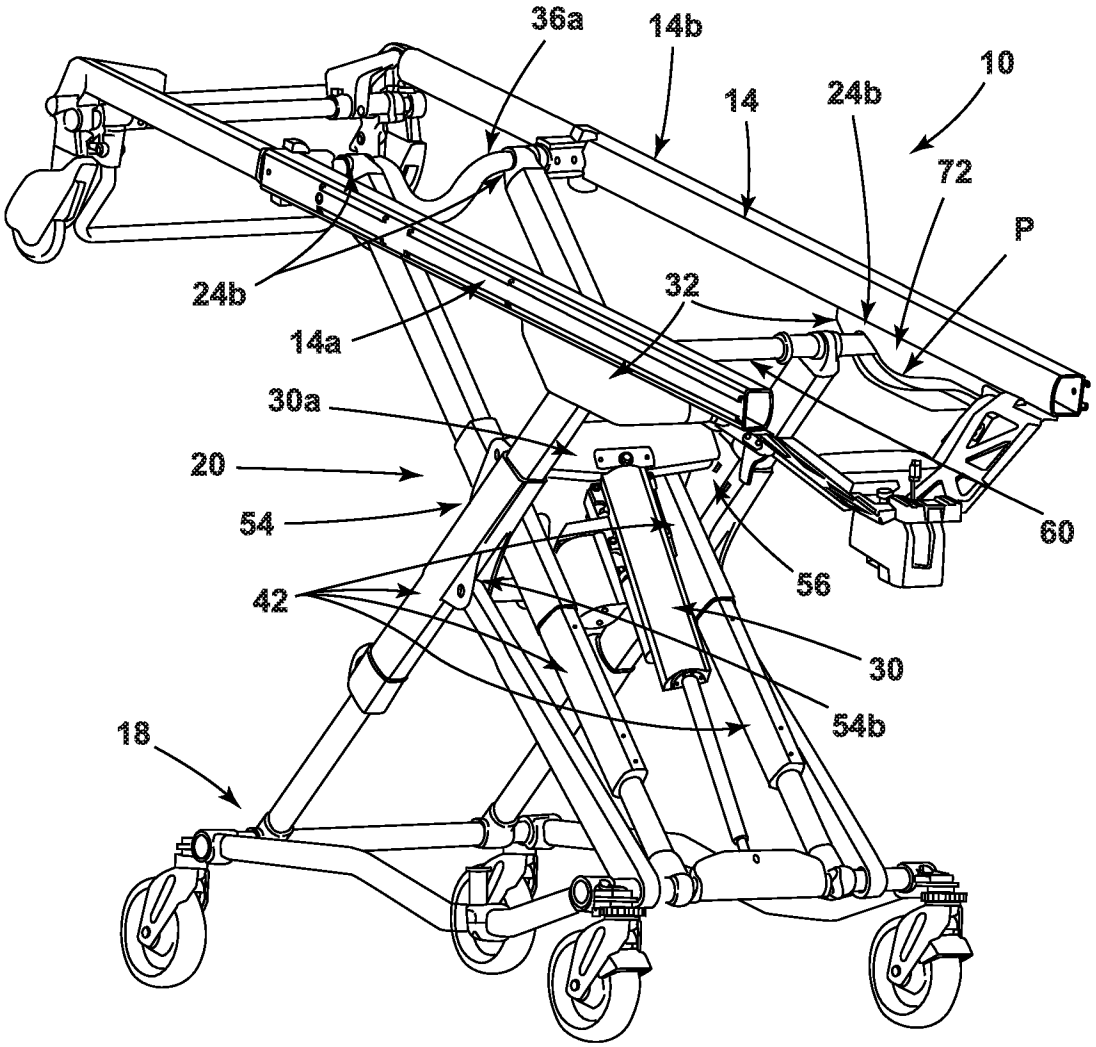
FIG. 1A is a second perspective view of the emergency cot of FIG. 1.
Figure 1B:
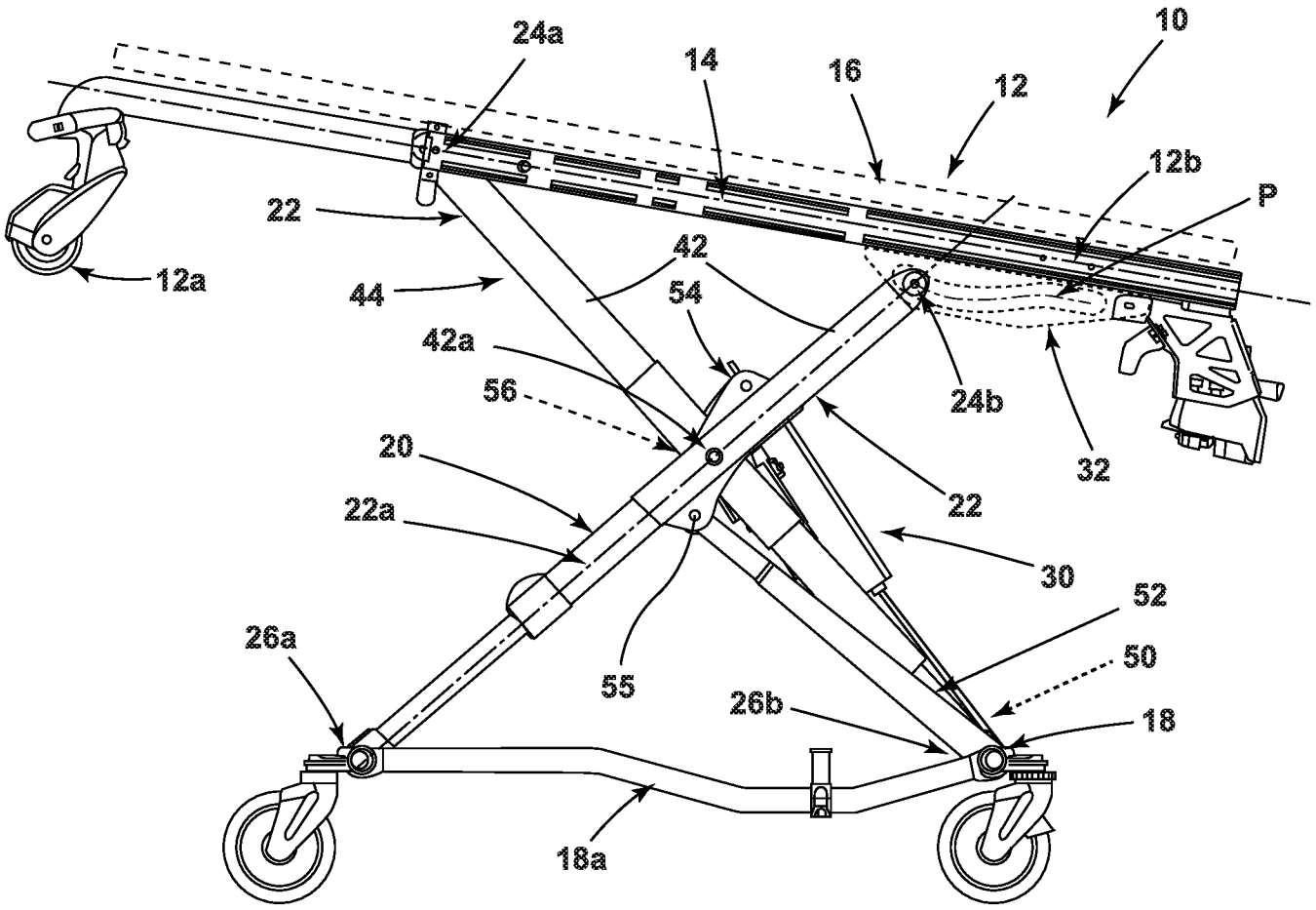
FIG. 1B is a side elevation view of the cot of FIG. 1 with the litter deck shown in phantom.
Figure 2:
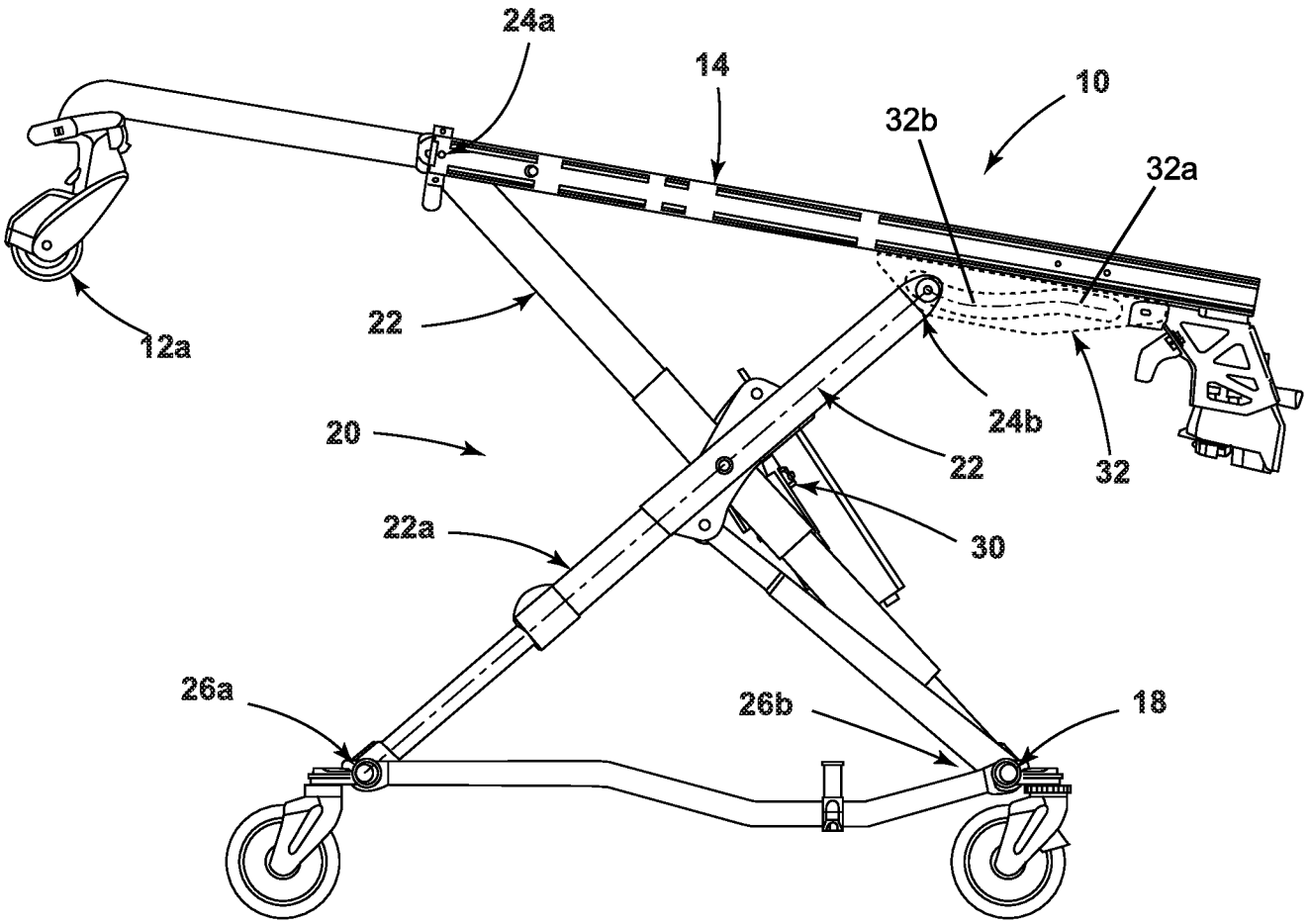
FIG. 2 is similar view to FIG. 1 with the litter deck removed and the head-end of the litter frame fully tilted upwardly.
Figure 3:
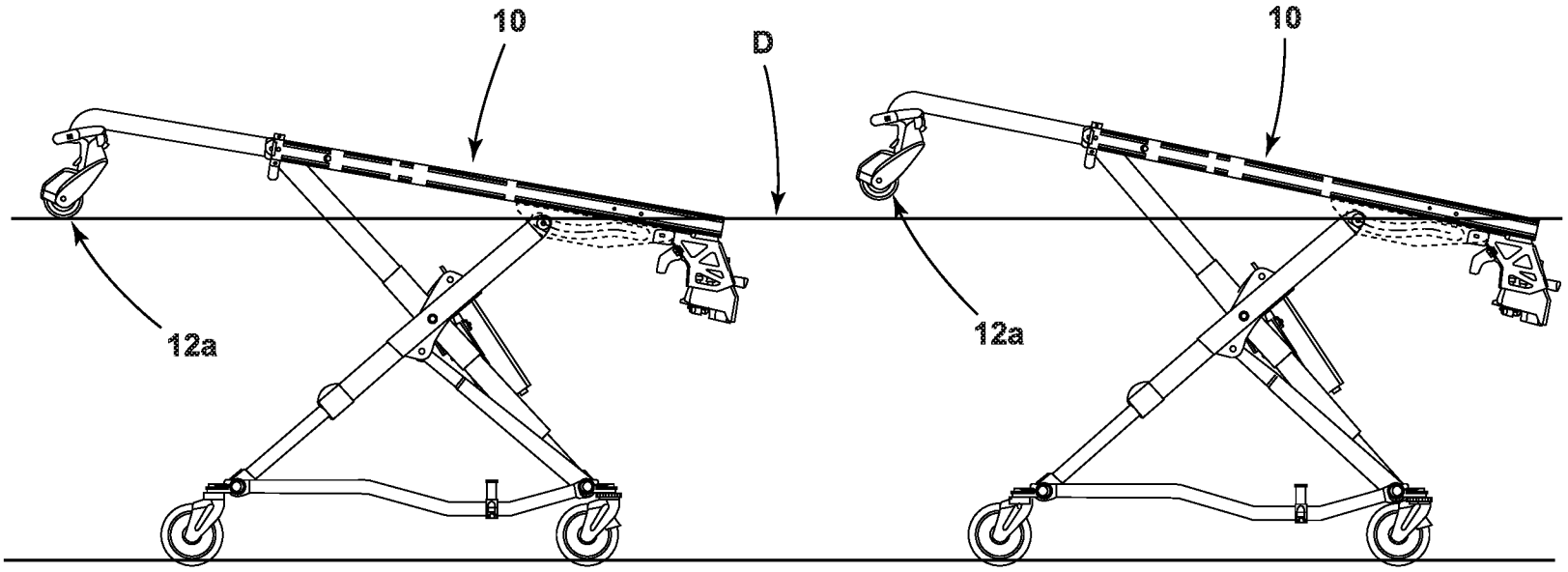
FIG. 3 is a side by side comparison of the cot configurations of FIGS. 1B and 2 to show the increased tilt of the litter frame.

For example, referring to FIG. 3, which shows a side-by-side comparison of the cot 10 when in its fully raised and tilted position (as shown in FIG. 1B) and its fully raised, but further tilted position (as shown in FIG. 2), the end (head-end or foot-end) of litter 12 may be tilted upwardly an additional distance in a range of about 0 to 2 inches above a reference line D when a force (represented by the arrow in FIG. 3) is applied to the foot end of litter 12. Reference line D represents the tangent line to the bottom of the litter head-end wheel 12*a* when in its fully raised and tilted position (as shown in FIG. 1B)). This additional tilt allows the cot to have a greater range of motion and may facilitate loading the cot 10 into emergency vehicles with higher compartments. In addition, in the illustrated embodiment, the litter 12 can be tilted without decoupling the litter 12 from the lift assembly 20.

Referring again to FIG. 1B, litter 12 is mounted to base 18 by lift assembly 20, which includes load bearing members 22 pivotally coupled to the litter frame 14 and to the base 18. In the illustrated embodiment, load bearing members 22 are pivotally coupled to the litter frame 14 by head-end upper pivot connections 24*a* and foot-end upper pivot connections 24*b*. Further, as will be more fully described below, head-end upper pivot connections 24*a* are fixed to the litter frame 14 along the longitudinal axis 12*b* of litter 12 and foot-end upper pivot connections 24*b* are movable so that the head-end of litter frame 14 can be tilted upwardly, as described above. Alternately, as noted above, the cot 10 may be configured so that the foot-end of litter frame 14 can tilt upwardly, and hence configured with movable head-end upper pivot connections. Optionally, cot 10 may be configured with two movable upper pivot connections, which are configured so that each pivot connection can be fixed (longitudinally) and the other free to move. For example, each pivot connection may include a stop that is manually movable between an operative position to longitudinally fix the pivot connection and a non-operative position where the pivot connection is movable. In this manner, a user can select which end of the litter to pivot.

As best seen in FIG. 1, lift assembly 20 is coupled to base 18 by longitudinally fixed head-end lower pivot connections 26*a* and longitudinally fixed foot-end lower pivot connections 26*b* so that when expanded or contract, lift assembly 20 raises or lowers the base 18 or the litter frame 14 with respect to the other. To expand or contract the lift assembly 20, lift assembly 20 includes a linear actuator 30, such as a hydraulic cylinder, described more fully below.

In the illustrated embodiment, movable foot-end upper pivot connections 24*b* are configured so that they can move in a direction angled (e.g. oblique (acute or obtuse) or even perpendicular) relative to the longitudinal axis 12*b* of frame 12 and optionally along or relative to the longitudinal axis 12*b* (FIG. 1B) of the litter 12. In this manner, the movable foot-end upper pivot connections 24*b* follow a non-linear path P that takes them toward or away from the longitudinal axis 12*b* of the litter 12 over at least a portion of the range of motion of the movable foot-end upper pivot connections 24*b* to cause the litter frame 14 to tilt relative to the lift assembly 20 (as opposed to being tilted by the lift assembly).

Referring to FIGS. 1, 1A, 1B and 2, this range of motion where the litter frame 14 tilts may be at one end of the range of motion of the foot-end upper pivot connections 24*b* and, for example, where lift assembly 20 is raised to its maximum height. Further, after lift assembly 20 has raised litter 12 to its maximum raised height, litter 12 may be tilted further (see FIG. 2) to raise the head-end of the litter 12 so that head-end wheels 12*a* can be raised sufficiently to rest on the deck of an emergence vehicle compartment.

Referring again to FIGS. 1A and 1B, movable foot-end upper pivot connections 24*b* are mounted to litter frame 14 by guides 32. Guides 32 form a non-linear guide path P (FIGS. 1-5) ("non-linear path" means a path that does not form a straight line) for the movable foot-end upper pivot connections 24*b*. While guide path P is non-linear, path P may include one or more linear sections and one or more non-linear sections, such as arcuate sections. In the illustrated embodiment, each guide 32 provides a non-linear guide path P with at least one linear section 32*a* that corresponds to the lowered height of the lift assembly 20 where movable foot-end upper pivot connections 24*b* are at their lowest height and lift assembly 20 is in its folded, most compact configuration (see FIG. 5). The path P of each guide 32 also includes an arcuate section 32*b*, which is adjacent linear section 32*a* and may have a single radius of curvature or two or more radii of curvatures. Further, each arcuate section 32*b* may have two portions, with a first portion corresponding to the fully raised height of lift assembly 20 and a second portion corresponding to the fully raised height of lift assembly 20 (FIG. 1B), but with the litter frame 14 tilted further (FIG. 2), as more fully described below.

Figure 4:
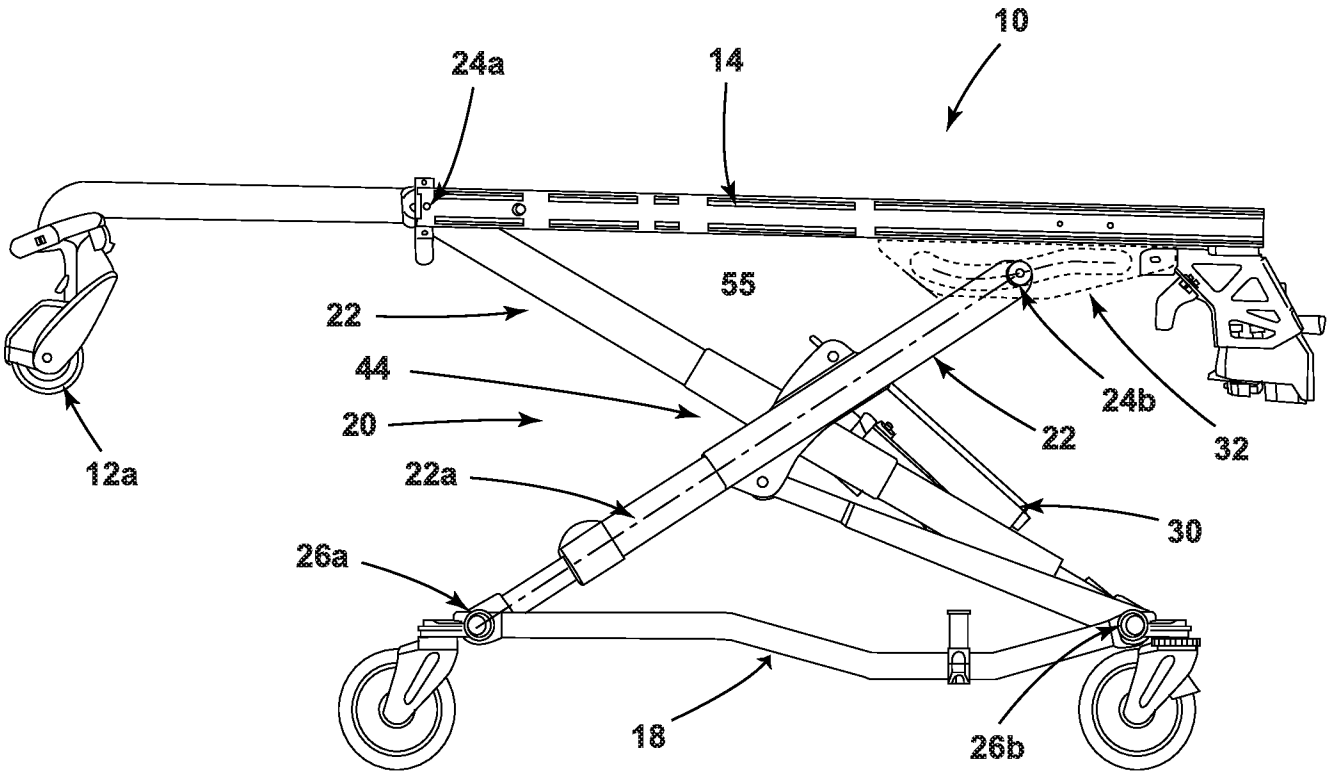
FIG. 4 is another side elevation view similar to FIGS. 1 and 2 but with the litter lowered to an intermediate height.

Thus, when lift assembly 20 starts in its lowermost position and is extended, movable foot-end upper pivot connections 24*b* move along guide path P from, for example, one end (see FIG. 5, which corresponds to the lowermost position of lift assembly 20) where the movement of movable foot-end upper pivot connections 24*b* is generally linear (and parallel to longitudinal axis 12*b* of litter 12) to a non-linear portion of path P, which corresponds to a raised position of lift assembly 20. As lift assembly 20 continues to extend and raise litter 12 further, movable foot-end upper pivot connections 24*b* continue to move along non-linear path P and initially move further away from longitudinal axis 12*b* (while still moving relative or along longitudinal axis 12*b*). During this movement, litter 12 remains substantially horizontal (FIG. 4). As lift assembly 20 continues to extend to its fully raised position, movable foot-end upper pivot connections 24*b* continue to move along the non-linear portion of path P and, further, continue to move away from longitudinal axis 12*b*. This movement is then followed by movable foot-end upper pivot connections 24*b* moving toward longitudinal axis 12*b* where litter 12 tilts upwardly (FIG. 1B). It should be understood that the positions of load bearing members 22 and movable foot-end upper pivot connections 24*b* are controlled and "locked" in their positions by the hydraulic cylinder.

Thus, the lift assembly 20 is coupled to the litter frame 14 of the litter 12 by a first pair of pivots or pivot connections 24*a* and a second pair of pivots or pivot connections 24*b*. As described above, the first pivots 24*a* are fixed in position along the longitudinal axis 12*a* of the litter 12. The second pivots 24*b* each have a second pivot axis that is guided along the guide path P of respective guide 32 with respect to the longitudinal axis of the litter. As noted above, the guide path P forms an oblique angle relative to the longitudinal axis 12*a* of the litter 12 over at least a portion of the guide path P. In addition, the first pivots 24*a* are located inwardly from the first end, e.g. head end, of litter 12, and the second pivots 24*b* are located inwardly from the second end, e.g. foot end, of the litter 12. With this arrangement, the first end, e.g. the head-end, of the litter 12 extends in a cantilevered arrangement beyond the first pair of pivots 24*a*, and the second end, e.g. the foot-end, of the litter 12 extends in a cantilevered arrangement beyond the second pivots 24*b*, wherein a force applied adjacent to or at the second end raises the first end of the litter 12 beyond the first pivot.

In this manner, a force applied adjacent to or at the second end 24*b* shifts the relative distribution of the weight between the first pivots 24*a* and the second pivots 24*b* in such a way as to cause a reduction in force on the first pivots 24*a* and an increase in the relative force on the second pivots.

In addition, when the force is applied adjacent to or at the second end the guides 32 form cams operable to urge the second pivots 24*b* closer to the first pivots 24*a*.

Further, as noted, the guide paths of guides 32 may each include at least one curved portion, with the curved portions of the guide paths forming the cams.

Therefore, in the illustrated embodiment, in order to further tilt litter 12 upwardly from its position shown in FIG. 1B to its position shown in FIG. 2, a downward force is applied to the foot-end of the litter 12, which causes relative movement between guides 32 and foot-end upper pivot connections 24*b*, which results in guides 32 urging (via a cam action) movable foot-end upper pivot connections 24*b* to move along path P, for example, toward or to the (other) end of path P, and move further towards longitudinal axis 12*b*. Because the position of foot-end upper pivot connections 24*b* is essentially fixed or locked in its position shown in FIG. 1B, only an external force will cause upper pivot connections 24*b* to move toward or to the end of path P as shown in FIG. 2. It should be noted that the most tilted position need not be at the end of recess 74 and instead may be provided at an intermediate location along recess 74. As noted this external force may simply be manually applied by an attendant, such as an EMS person, at the foot-end of the litter 12—or it may be applied by an actuator, such as pneumatic, mechanical, electro-mechanical, or hydraulic actuator.

In the illustrated embodiment, each load bearing member 22 comprises a telescoping compression/tension member 42. Compression/tension members 42 may be pivotally joined at their medial portions about a pivot axis 42*a* (FIG. 1B) to thereby form a pair of X-frames 44. The upper ends of each X-frame 44 are, as would be understood, pivotally mounted to the litter frame 14 by head-end upper pivot connections 24*a* and foot-end upper pivot connections 24*b*. The lower ends of each X-frame 44 are pivotally mounted to the base 18 by head-end lower pivot connections 26*a* and foot-end lower pivot connections 26*b*. However, it should be understood that load bearing members 22 may comprise fixed length members, for example such of the type shown in U.S. Pat. No. 6,701,545, which is commonly owned by Stryker Corp. of Kalamazoo, Mich. and incorporated herein by reference in its entirety.

In addition to load bearing members 22, cot 10 includes a pair of linkage members 50 and 52, which are pivotally mounted on one end to transverse frame members 18*b* of base 18 and on their other ends to brackets 54, 56 (FIG. 1), which also provide a mount for the linear actuator 30 described more fully below. Brackets 54 and 56 are mounted about the upper portions of telescoping members 42, and include upper flanges 54*a*, 56*a*, respectively, which support there between a transverse member 30*a* (FIGS. 1A and 1E). Transverse member 30*a* is pivotally mounted at its ends between flanges 54*a*, 56*a* and provides a mount for the fixed end of linear actuator 30. In this manner, as actuator 30 extends or contracts to raise or lower lift assembly 20, the fixed end of actuator 30 can pivot or rotate about the horizontal axis formed by transverse member 30*a* between brackets 54 and 56.

Referring again to FIG. 1, brackets 54 and 56 also include a second pair of flanges 54*b* (FIG. 1A), 56*b*, which are below upper flange 54*a*, 56*a* and provide mounts for linkages 50, 52, as noted above, and which are secured thereto by fasteners 55 (FIG. 1B). Thus, brackets 54 and 56 pivotally mount actuator 30 and linkage members 50 and 52 to X-frames 44, which linkage members 50, 52 provide timing links and, further, moment couplers to assist driving the X-frames 44 when actuator 30 is extended or retracted.

Figure 6:
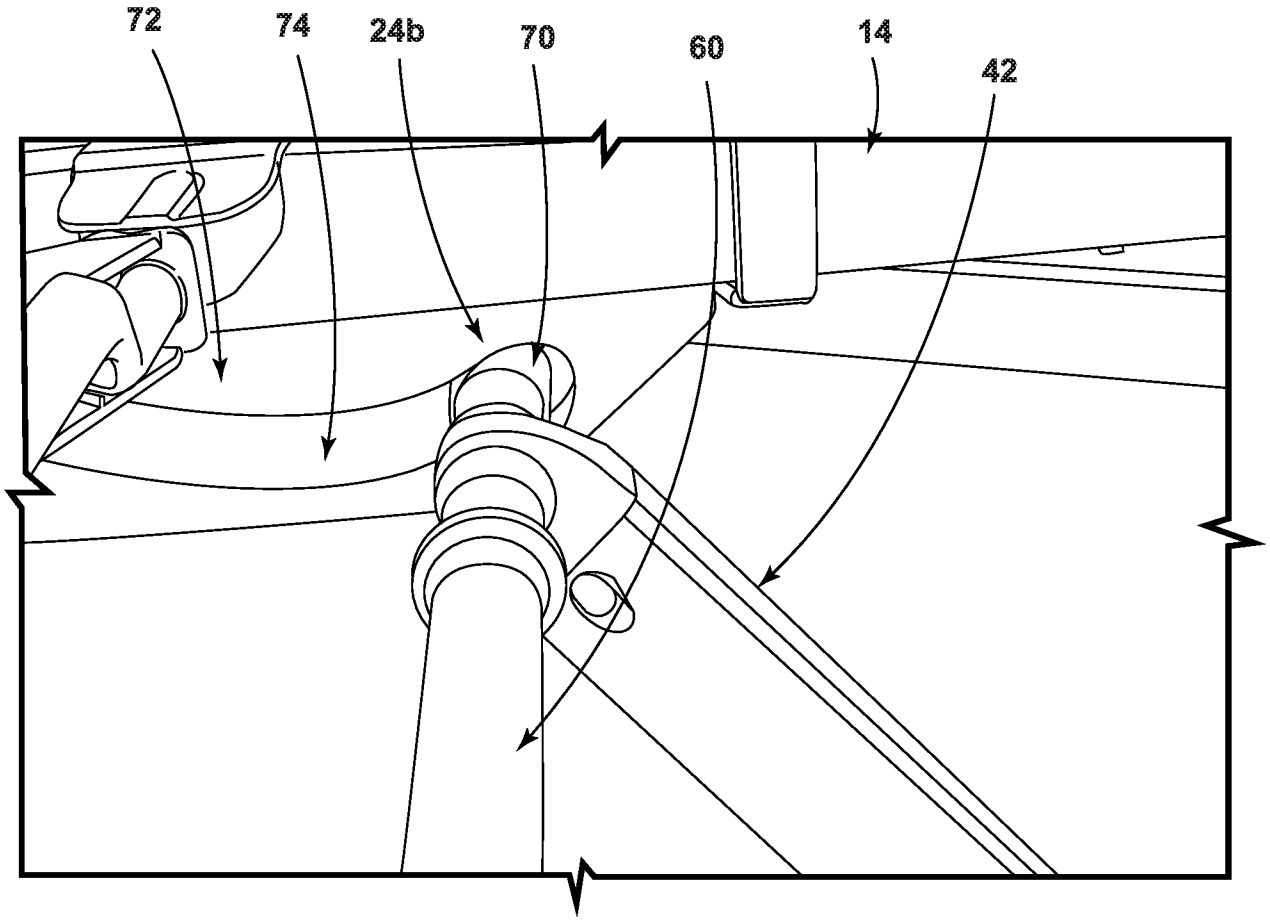
FIG. 6 is an enlarged view of the foot-end pivot connection illustrating a guide that provides a height adjustment function and a tilting function.

As best seen in FIG. 6, foot-end upper pivot connections 24*b* are supported on or formed by a transverse member 60 (see also FIG. 1A), which is mounted to the upper ends of telescoping members 42 by a rigid connection. In the illustrated embodiment, foot-end upper pivot connections 24*b* are formed by the ends of transverse member 60. For example, transverse member 60 may comprise a tubular member or solid bar with a circular cross-section. To accommodate the rotation of each telescoping member 42 (as lift assembly 20 is extended or retracted) and allow each telescoping member 42 at the foot-end to pivot and translate along guide path P, foot-end upper pivot connections 24*b* each include a roller 70 (FIG. 6). Rollers 70 are mounted about the respective ends of transverse member 60 and guided along guide paths P of guides 32. For example, rollers 70 may each comprise a low friction collar, such as a high density polyethylene collar, or a bearing assembly, which is free to rotate about the end of tubular member and further, as noted, roll along guide path P.

In the illustrated embodiment, and as best seen in FIGS. 1A, and 6, guides 32 are each formed from a low friction member or plate 72, such as a high density polyethylene plate, mounted to litter frame 14. As best seen in FIG. 6, each low friction member or plate 72 includes a recess 74 formed therein, which forms guide path P. Recesses 74 may extend partially into low friction members or plates 72 to form channels therein or may extend through low friction members or plates 72 to form openings therein. In the illustrated embodiment, recess 74 forms a channel so that guides 32 also can provide a lateral restraint to transverse member 60. Alternately, guides 32 may be formed from a metal member or plate with the recesses formed therein lined with a low friction material, such as high density polyethylene.

As noted above, foot-end upper pivot connections 24*b* may each include a roller 70 (FIG. 6). Rollers 70 are located in recesses 74 of guides 32 and roll along recesses 74 to guide foot-end upper pivot connections 24*b* along path P. Alternately, foot-end upper pivot connections 24*b* may each have a sufficiently low friction surface or interface with recesses 74 to allow foot-end upper pivot connections 24*b* to slide along path P.

In this manner, foot-end upper pivot connections 24*b* allow telescoping members 42 to pivot about a moving horizontal axis (i.e. the moving horizontal axis of transverse member 60) (moving in the longitudinal direction and/or vertical direction, as noted above, namely along longitudinal axis 12*a* and/or toward or away from longitudinal axis 12*a*) and, further, allow lift assembly 20 to adjust the height of litter 12 relative to base 18.

However, it should be understood that other structures may be provided to form a guide for the upper pivot connections 24*b*. For example, a linkage assembly (e.g. a four bar linkage assembly) may be mounted to litter frame 14 to guide and provide a guide path for foot-end upper pivot connections 24*b*.

Figure 1C:
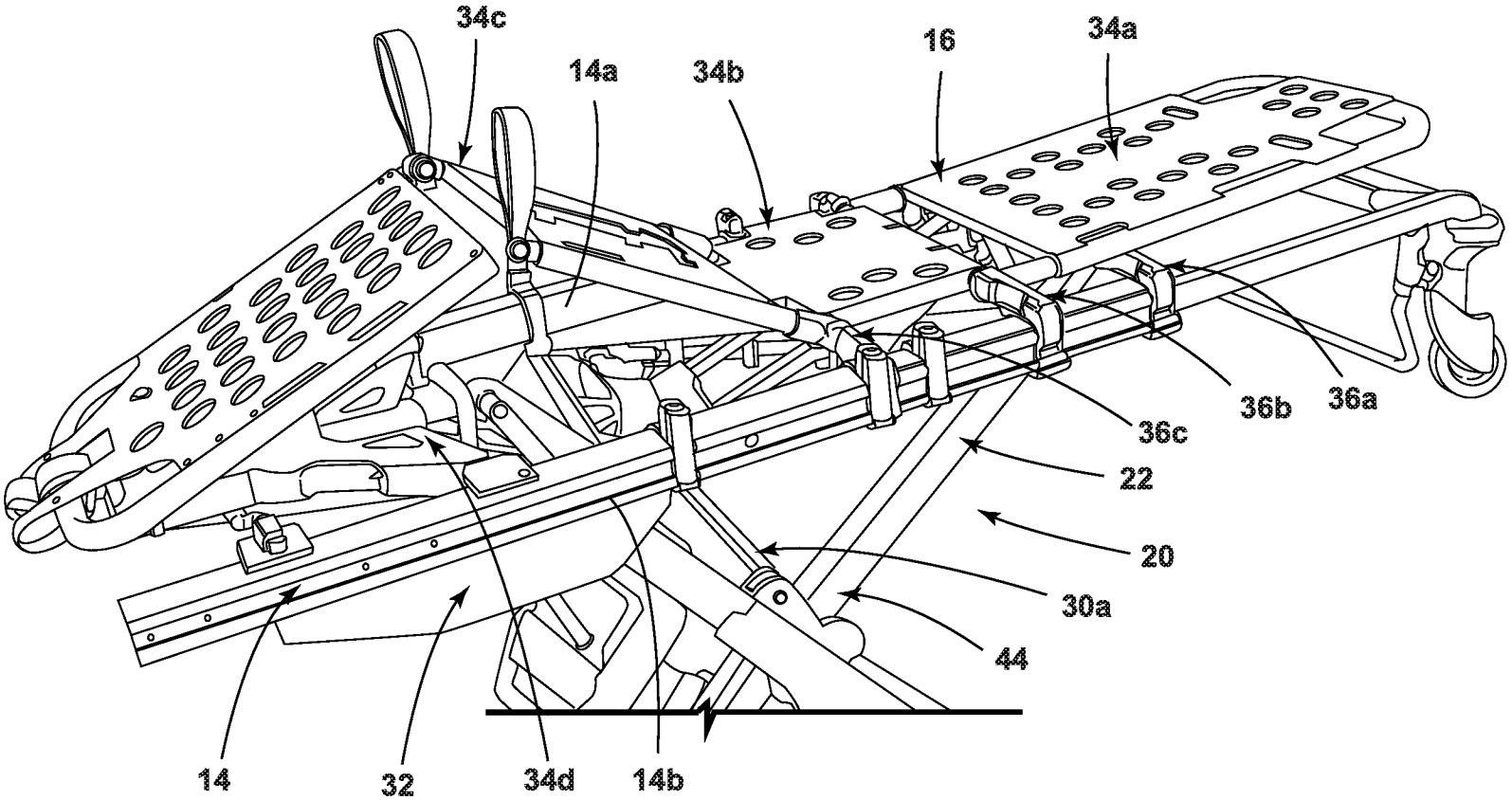
FIG. 1C is a partial perspective view of the cot of FIG. 1 with the litter deck shown mounted to the litter frame.

As best seen in FIG. 1C, litter deck 16 optionally includes a backrest section 34*a*, a seat section 34*b*, and a leg section 34*c*, with sections 34*a* and 34*c* being pivotally mounted to litter frame 14. Optionally, leg section 34*c* includes a gatch mechanism 34*d*, which allows the leg section 34*c* to bend as shown, for example near the patient's knees, which can prevent a patient from slipping and also make it more comfortable for the patient.

In addition, referring again to FIGS. 1A and 1C, litter frame 14 includes a pair of side frame members 14*a* and 14*b*, which are interconnected by one or more cross- or transverse frame members 36*a*-36*c*. Cross-frame member 36*a* provides a mounting point for the head-end load bearing members 22 of lift assembly 20. And, the other cross-frame members may provide support for the sections (34*a*, 34*b*, and 34*c*) of litter deck 16. In addition, side frame members 14*a* and 14*b* may provide a mounting surface for collapsible side rails (not shown).

Figure 1D:
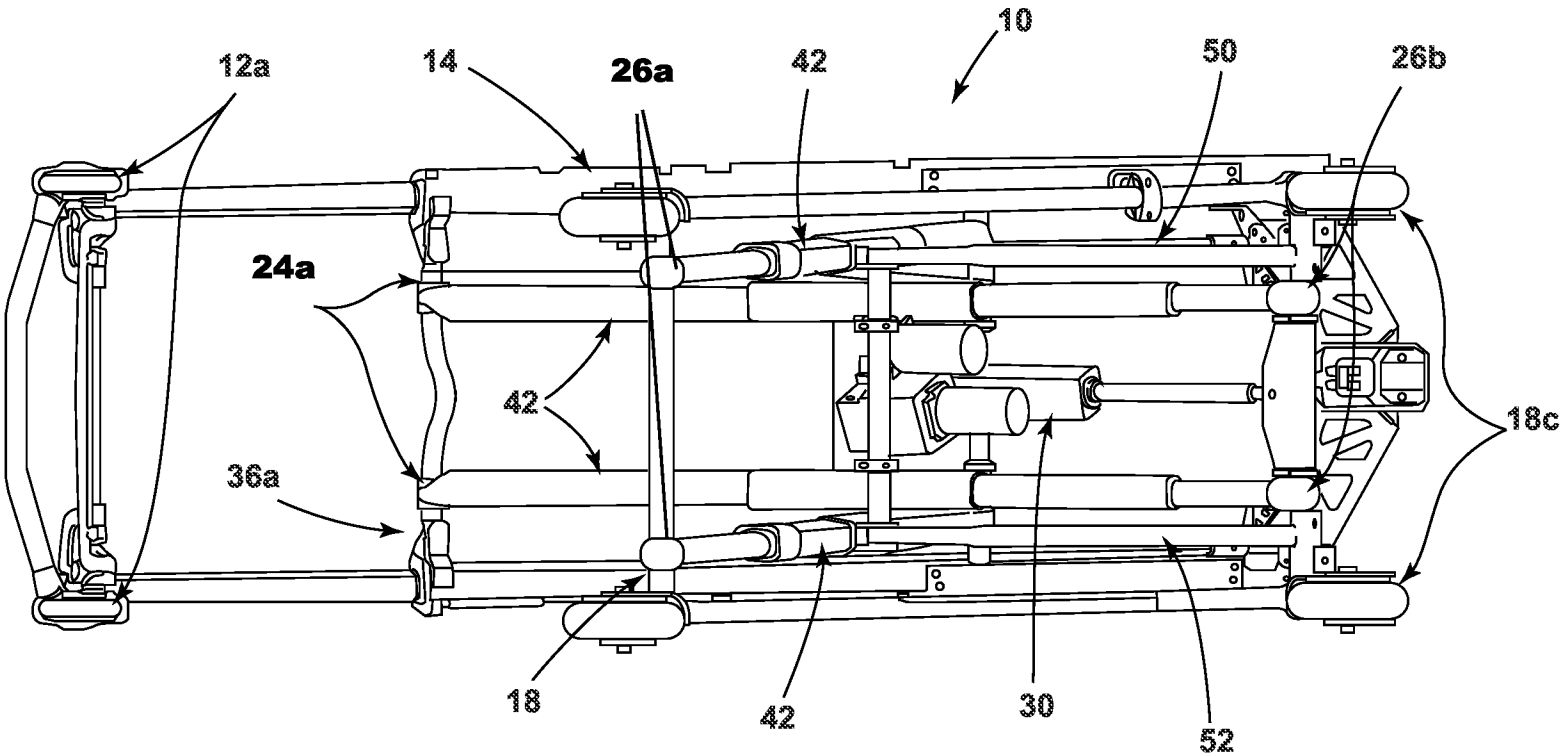
FIG. 1D is a bottom plan view of the cot of FIG. 1B.
Figure 1E:
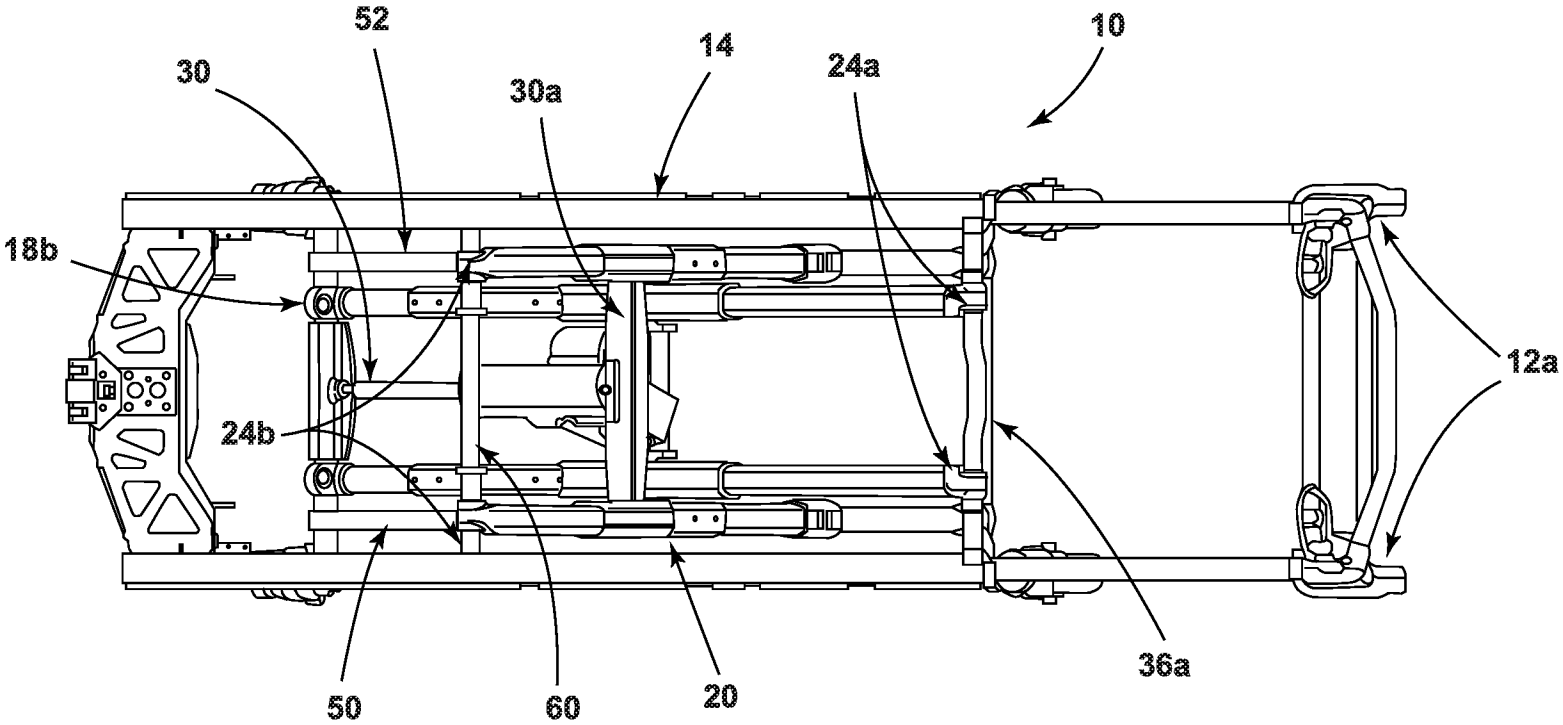
FIG. 1E is a top plan view of the cot of FIG. 1B.

As best seen in FIG. 1, base 18 is formed by longitudinal frame members 18*a* and transverse frame members 18*b*, which are joined rigidly together to form a frame for base 18. Mounted to the longitudinal frame members 18*a* are bearings 18*c* (see also FIG. 1D), such as wheels or castors. Transverse frame members 18*b* provide a mount for the lower pivot connections 24*a*, 24*b* of load bearing members 22 and also for the rod end of the actuator 30. As noted above, the upper end (fixed end) of actuator 30 is mounted between the X-frames 44 (formed by load bearing members 22) by transverse member 30*a* (FIG. 1A), which is rotatably mounted to brackets 54, 56.

As noted above, lift assembly 20 is extended or contracted by actuator 30. In the illustrated embodiment actuator 30 comprises a hydraulic cylinder 80 (with an extendible rod), which is part of a hydraulic control system to extend or contract lift assembly 20. Optionally, control of the flow of fluid to and from hydraulic cylinder may be achieved using the hydraulic control circuit and control system described in U.S. Pat. No. 7,398,571, which is commonly owned by Stryker Corp. of Kalamazoo, Mich. and incorporated herein by reference in its entirety. Alternately, control of the flow of fluid to and from hydraulic cylinder 80 may be achieved using the hydraulic control circuit and control system described in copending provisional application entitled PATIENT HANDLING APPARATUS WITH HYDRAULIC CONTROL SYSTEM (Ser. No. 62/488,444) and filed on even date herewith, which is incorporated herein by reference in its entirety. Further yet, linear actuator 30 may comprise a pneumatic or electro-mechanical actuator.

In addition to providing a mechanism to allow open end of litter frame 14 to be tilted (when an external force is applied to the opposed end of litter frame 14), guide path P may be configured to maintain litter 12 generally horizontal when lift assembly 20 raises litter 12. As noted above, guide path P may include a linear section (where cot 10 is collapsed and litter 12 is fully lowered relative to base, see FIG. 5) and a non-linear section, such as arcuate section. In the illustrated embodiment, the non-linear section comprises an arcuate section where guide path P initially increases the angle between the guide path P and the longitudinal axis 12*a* of litter 12. By increasing the angle between of path P and the longitudinal axis 12*a* of litter 12, the tendency of lift assembly 20 to tilt the head-end of litter 12 upwardly when it is extended is counteracted by the shortening of the telescoping members 42 that are coupled to foot-end pivot connections 24*b* (due to the dip in guide path P) so that litter 12 can remain substantially horizontal while it is being raised. But as lift assembly 20 approaches its full extension, the angle between the guide path P and the longitudinal axis 12*a* reduces so that litter 12 tilts upwardly as shown in FIG. 1B. In this manner, for example, the angle of the longitudinal axis 12*a* of litter can move from about negative 2 degrees below horizontal (assuming cot is on a horizontal surface) to about horizontal (about 0 degrees above horizontal), and remain generally horizontal while lift assembly 20 lifts litter 12 until lift assembly 20 is almost fully extended, as which point the litter 12 can then be tilted to a range of about 8 to 14 degrees above horizontal, and optionally range of about 10 to 12 degrees above horizontal above horizontal. When litter 12 is further tilted by an external force (manually or by an actuator) as described above, litter 12 can then be tilted to a range of about 10 to 16 degrees above horizontal, and optionally range of about 12 to 14 degrees above horizontal above horizontal.

For further details of litter 12, litter deck 16, litter frame 14, telescoping members 42, base 18, brackets 54 and 56, linkage members 50 and 52, and gatch mechanism 34*d*, and other structures not specifically mentioned or described herein, reference is made to U.S. Pat. Nos. 5,537,700 and 7,398,571, and published Application No. WO 2007/123571, commonly owned by Stryker Corporation, which are herein incorporated by reference in their entireties.

Figure 5:
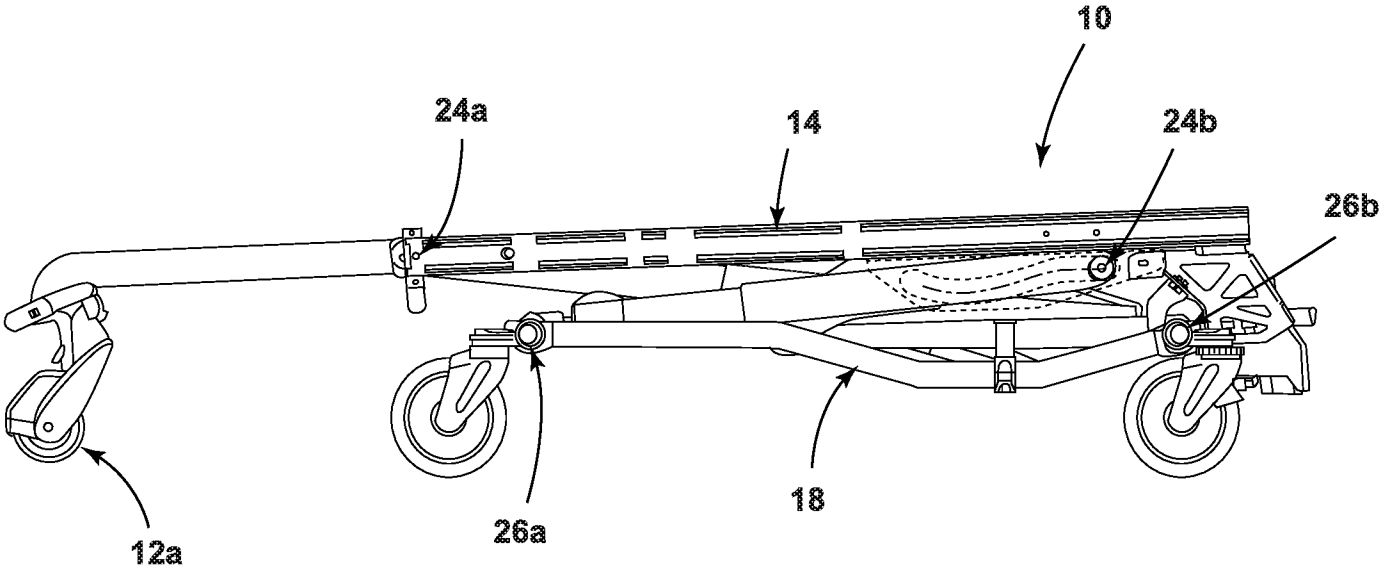
FIG. 5 is similar view to FIG. 1 with the litter fully lowered.

Thus, when the ambulance cot is in the fully collapsed position, and referring to FIG. 5, an extension of the linear actuator 30 will generate a moment force about pivot axis 42*a* of X-frames 44, which will cause telescoping members 42 to pivot about axis 42*a* and raise upwardly. Similarly, when linear actuator 30 contracts, actuator 30 will generate a moment force to X-frames 44 about pivot axis 42*a* in an opposed direction to cause telescoping members 42 to lower. As a result of this geometry, the force in the direction of the extension of linear actuator 30 effects a rapid lifting of the litter 12 from the positions illustrated in FIG. 5 through the mid-height position illustrated in FIG. 4 to the full height position of the lift assembly illustrated in FIGS. 1B and 2. Similarly, when lift assembly 20 is in its fully raised position, the base may be raised or the litter frame may be lowered by contracting actuator 30 (depending on which is supported—that is depending on whether the base 18 is on a ground or floor surface in which case the litter 12 will be lowered when actuator 30 is contracted. If, on the other hand, the litter 12 is supported, e.g. by an attendant or by a loading and unloading apparatus, then contracting actuator 30 will raise base 18 relative to litter 12.

Accordingly, the present invention provides a cot with a litter that can be tilted relative to the lift mechanism to facilitate loading of cot into an emergency vehicle, while the lift assembly 20 remains operable to raise or lower the litter.

The terms "head-end" and "foot-end" used herein are location reference terms and are used broadly to refer to the location of the cot that is closer to the portion of the cot that supports a head of a person and the portion of the cot that supports the feet of a person, respectively, and should not be construed to mean the very ends or distal ends of the cot.

While several forms of the invention have been shown and described, other forms will now be apparent to those skilled in the art. For example, one or more of the features of the cot 10 may be incorporated into other cots. Similarly, other features form other cots may be incorporated into cot 10. Examples of other cots that may incorporate one or more of the features described herein or which have features that may be incorporated herein are described in U.S. Pat. Nos. 7,398,571; 7,100,224; 5,537,700; 6,701,545; 6,526,611; 6,389,623; and 4,767,148, and U.S. Publication Nos. 2005/0241063 and 2006/0075558, which are all incorporated by reference herein in their entireties. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. An emergency cot comprising:

a litter frame having a head-end, a foot-end, and a longitudinal axis;

a base; and a lift assembly supporting said litter frame relative to said base, said lift assembly including load bearing members pivotally coupled to said litter frame by head-end upper pivot connections and foot-end upper pivot connections and pivotally coupled to said base by head-end lower pivot connections and foot-end lower pivot connections for raising or lowering said base or said litter frame with respect to the other, said foot-end upper pivot connections being mounted relative to said litter frame by guides and being movable along a non-linear path in a direction oblique to said longitudinal axis of said litter frame over at least one range of motion of said foot-end upper pivot connections, wherein each of said guides has an elongate guide surface, wherein each of said elongate guide surfaces has a first section corresponding to a lowered and substantially un-tilted position of said litter frame and a second section corresponding to a raised and tilted position of said litter frame, said second sections of said elongate guide surfaces being adjacent said first sections of said elongate guide surfaces and being tilted relative to said first sections to allow said foot-end upper pivot connections to move along said longitudinal axis and to move toward or away from said longitudinal axis of said litter frame to thereby allow said litter frame to be tilted without decoupling said litter frame from said load bearing members.

2. The emergency cot according to claim 1, wherein said second section of each of said elongate guide surfaces is non-linear with a first portion and a second portion wherein said foot-end upper pivot connections move along said longitudinal axis of said litter frame away from said longitudinal axis of said litter frame when said foot-end upper pivot connections move along said first portions of said second sections of said elongated guide surfaces and move toward said longitudinal axis of said litter frame when said foot-end upper pivot connections move along said second portions of said second sections of said elongated guide surfaces to allow said head-end of said litter frame to be tilted upwardly.

3. The emergency cot according to claim 1, wherein each of said first portions of said second sections is arcuate.

4. The emergency cot according to claim 1, wherein each of said second portions of said second sections is arcuate.

5. The emergency cot according to claim 1, wherein said foot-end upper pivot connections comprise rolling foot-end upper pivot connections.

6. The emergency cot according to claim 5, wherein each of said rolling foot-end upper pivot connections includes a roller to roll along a respective elongate guide surface.

7. The emergency cot according to claim 1, wherein each of said guides has an elongate recess or opening formed therein, said elongate recesses or openings defining said elongate guide surfaces.

8. The emergency cot according to claim 7, wherein each of said guides is formed from a high density polyethylene material.

9. The emergency cot according to claim 1, wherein said load bearing members comprise compression/tension members.

10. The emergency cot according to claim 9, wherein said compression/tension members comprise telescoping compression/tension members.

11. The emergency cot according to claim 10, wherein said telescoping compression/tension members comprise a first pair of telescoping compression/tension members forming a first X-frame and a second pair of telescoping compression/tension members forming a second X-frame.

12. The emergency cot according to claim 2, wherein said foot-end upper pivot connections are configured to allow said head-end of said litter frame to be tilted upwardly without decoupling said litter frame from said load bearing members.

13. The emergency cot according to claim 1, wherein said foot-end upper pivot connections are guided along a guide path with respect to said longitudinal axis, said guide path forming an oblique angle relative to said longitudinal axis over at least a portion of said guide path, the head-end of said litter frame extending in a cantilevered arrangement beyond said head-end upper pivot connections, and the foot-end of said litter frame extending in a cantilevered arrangement beyond said foot-end upper pivot connections wherein a force applied adjacent to or at said foot-end raises the head-end of the litter frame beyond said head-end upper pivot connections.

14. The emergency cot according to claim 13, wherein said guide path includes at least one curved portion.

15. The emergency cot according to claim 14, wherein said guide path includes at least one curved portion, said curved portion being forming by a cam operable to urge said foot-end pivot connections closer to said head-end pivot connections.

16. The emergency cot according to claim 13, wherein said guide path forms an increasing angle relative to said longitudinal axis over at least a portion of said guide path.

* * * * *